United States Patent [19]

Fujii et al.

[11] Patent Number: 4,793,297

[45] Date of Patent: Dec. 27, 1988

[54] VALVE OPERATING MECHANISM FOR INTERNAL COMBUSTION ENGINE

[75] Inventors: Noriaki Fujii; Takeshi Iwata; Naoki Takahara, all of Saitama, Japan

[73] Assignee: Honda Giken Kogyo Kabushiki Kaisha, Tokyo, Japan

[21] Appl. No.: 71,653

[22] Filed: Jul. 9, 1987

[30] Foreign Application Priority Data

Jul. 9, 1986 [JP] Japan ..... 61-162859

[51] Int. Cl.[4] ..... F01L 1/44; F02F 1/24

[52] U.S. Cl. ..... 123/90.23; 123/90.44; 123/193 H

[58] Field of Search ..... 123/90.44, 90.23, 90.27, 123/90.39, 90.38, 90.37, 193 H

[56] References Cited

U.S. PATENT DOCUMENTS

| | | | |
|---|---|---|---|
| 4,549,510 | 10/1985 | Miyakoshi et al. | 123/90.44 |
| 4,558,667 | 12/1985 | Inagaki et al. | 123/90.44 |
| 4,592,314 | 6/1986 | Tsuchida | 123/90.44 |
| 4,617,881 | 10/1986 | Aoi et al. | 123/90.44 |
| 4,739,735 | 4/1988 | Ichida et al. | 123/90.23 |

FOREIGN PATENT DOCUMENTS

| | | | |
|---|---|---|---|
| 2739132 | 3/1979 | Fed. Rep. of Germany | 123/90.44 |
| 0035106 | 2/1985 | Japan | 123/90.23 |
| 2159877 | 12/1985 | United Kingdom | 123/90.23 |

*Primary Examiner*—Willis R. Wolfe
*Attorney, Agent, or Firm*—Lyon & Lyon

[57] ABSTRACT

An internal combustion engine, which includes a cylinder bore having an axis, a cylinder head disposed above the cylinder bore and having a combustion chamber, intake and exhaust valves movably supported in the cylinder head, and a spark plug supported in the cylinder head and having electrodes disposed centrally in the combustion chamber. A valve operating mechanism combined with an internal combustion engine comprising, a single camshaft rotatably disposed above the cylinder head, a single rocker arm shaft rotatably disposed above the cylinder head, an intake-valve rocker arm swingably supported on the rocker shaft and operatively engaging the intake valve, an exhaust-valve rocker arm swingably supported on the rocker shaft and operatively engaging the exhaust valve, a cam holder disposed above the cylinder bore, the camshaft being rotatably supported by the cam holder, a rocker holder disposed above the cylinder bore, the rocker arm shaft being rotatably supported by the rocker holder, and a plug insertion tube having a plug insertion hole for insertion of the spark plug therethrough, the plug insertion tube being integrally formed with the cam holder and the rocker holder.

6 Claims, 7 Drawing Sheets

VALVE OPERATING MECHANISM FOR INTERNAL COMBUSTION ENGINE

BACKGROUND OF THE INVENTION

1. Field of the Invention

The present invention relates to a valve operating mechanism of the SOHC (single overhead camshaft) type for an internal combustion engine.

2. Description of the Relevant Art

It is known in valve operating mechanisms of the SOHC type that rocker arms for operating intake and exhaust valves are supported on a common rocker arm shaft. Japanese Laid-Open Patent Publication No. 60-209612 and Japanese Laid-Open Utility Model Publication No. 61-152706 disclose SOHC-type valve operating mechanisms in which a camshaft is disposed above a rocker arm shaft, ignition spark plugs are disposed centrally above respective combustion chambers for increased combustion efficiency, and four valves are provided for each cylinder.

With the camshaft located above the rocker arm shaft, the rocker arms can be reduced in size and the rotational speed of the engine can be increased.

The centrally located spark plugs, which, are effective in knocking prevention, were previously installed through plug insertion pipes which were fitted and sealed in the cylinder head and a head cover. However, use of such additional plug insertion pipes results in an increased number of components required. Since the upper and lower ends of the plug insertion pipes have to be sealed, the number of steps for assembling the valve operating mechanism is large.

SUMMARY OF THE INVENTION

It is an object of the present invention to provide a valve operating mechanism for use in an internal combustion engine, which permits spark plugs to be centrally located in combustion chambers for improved combustion efficiency, is made up of a reduced number of parts, and can be assembled in a reduced number of assembling steps.

According to the present invention, there is provided a valve operating mechanism in an internal combustion engine, which includes a cylinder bore having an axis, a cylinder head disposed above the cylinder bore and having a combustion chamber, intake and exhaust valves movably supported in the cylinder head, and a spark plug supported in the cylinder head and having electrodes disposed centrally in the combustion chamber, the valve operating mechanism comprising a single camshaft rotatably disposed above the cylinder head, a single rocker arm shaft rotatably disposed above the cylinder head, an intake-valve rocker arm swingably supported on the rocker shaft and operatively engaging the intake valve, an exhaust-valve rocker arm swingably supported on the rocker shaft and operatively engaging the exhaust valve, a cam holder disposed above the cylinder bore, the camshaft being rotatably supported by the cam holder, a rocker holder disposed above the cylinder bore, the rocker arm shaft being rotatably supported by the rocker holder, and a plug insertion tube having a plug insertion hole for insertion of the spark plug therethrough, the plug insertion tube being integrally formed with the cam holder and the rocker holder.

The above and further objects, details and advantages of the present invention will become apparent from the following detailed description of preferred embodiment thereof, when read in conjunction with the accompanying drawings.

DETAILED DESCRIPTION OF THE PREFERRED EMBODIMENTS

Figure 1:
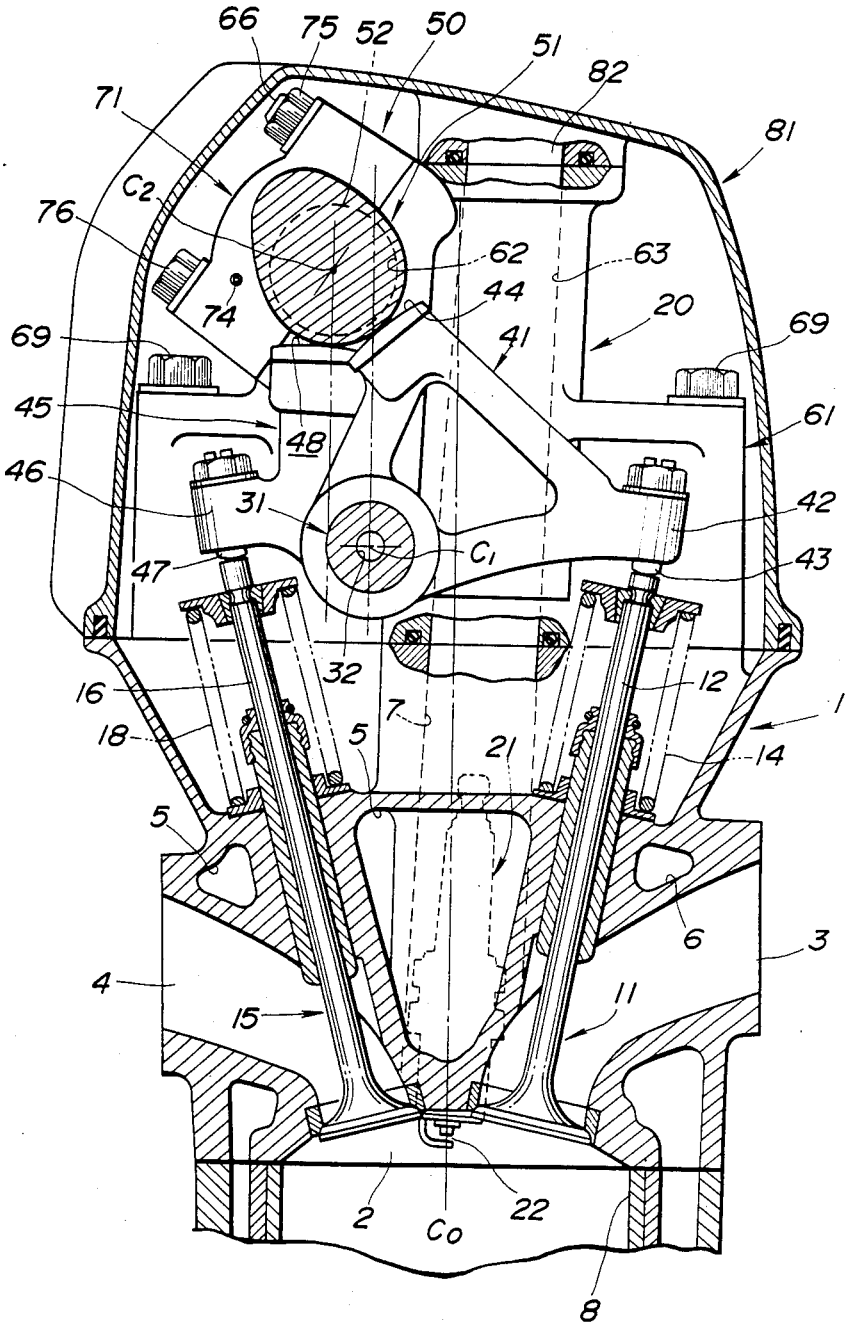
FIG. 1 is a vertical cross-sectional view of a valve operating mechanism according to a first embodiment of the present invention.

Like or corresponding parts are denoted by like or corresponding reference numerals throughout the views.

FIGS. 1 through 4 show a valve operating mechanism according to a first embodiment of the present invention. The valve operating mechanism is associated with an internal combustion engine having a cylinder head 1 supporting intake and exhaust valves 11, 15 and an ignition spark plug 21. The valve operating mechanism includes a rocker arm shaft 31, rocker arms 41, 45 swingably supported on the rocker arm shaft 31, a camshaft 51, and a head cover 81.

The cylinder head 1 is mounted on a cylinder block having a plurality of aligned cylinder bores 8. The cylinder head 1 has a plurality of combustion chambers 2 defined in lower portion thereof and communicating respectively with the cylinder bores. The cylinder head 1 also has a pair of intake ports 3 (only one shown) defined therein and opening into the combustion chamber 2 and a pair of exhaust ports 4 (only one shown) defined therein and opening into the combustion chamber 2. The intake and exhaust valves 11, 15 have valve heads disposed in the open ends of the intake and exhaust ports 3, 4, and are normally urged by valve springs 14, 18 to move in a direction to close the intake and exhaust ports 3, 4. The spark plug 21 has electrodes 22 located centrally in the upper portion of the combustion chamber 2 which is surrounded by the four ports 3, 4. The spark plug 21 is slightly inclined toward the intake valves 11. A water jacket 5 is defined in the cylinder head 1 near the exhaust ports 4, and another water jacket 6 is defined in the cylinder head 1 near the intake ports 3.

The single rocker arm shaft 31 is disposed above a V-shaped space defined by and between the intake and exhaust valves 11, 15. The rocker arm shaft 31 has its axis C1 displaced or offset laterally from the axis C0 of the cylinder bores 8. The rocker arms 45 associated with the exhaust valves 15 are substantially of a bell crank shape and swingably supported on the rocker arm shaft 31 one on each side of the cylinder bore axis C0. The rocker arms 41 of a substantially rectangular shape are also swingably supported on the rocker arm shaft 31 at positions outside of the rocker arms 45. The rocker arms 41, 45 have actuating portions 42, 46 on their distal ends which support adjustment screws 43, 47 held against the upper ends of valve stems 12, 16 of the valves 11, 15.

Figure 2:
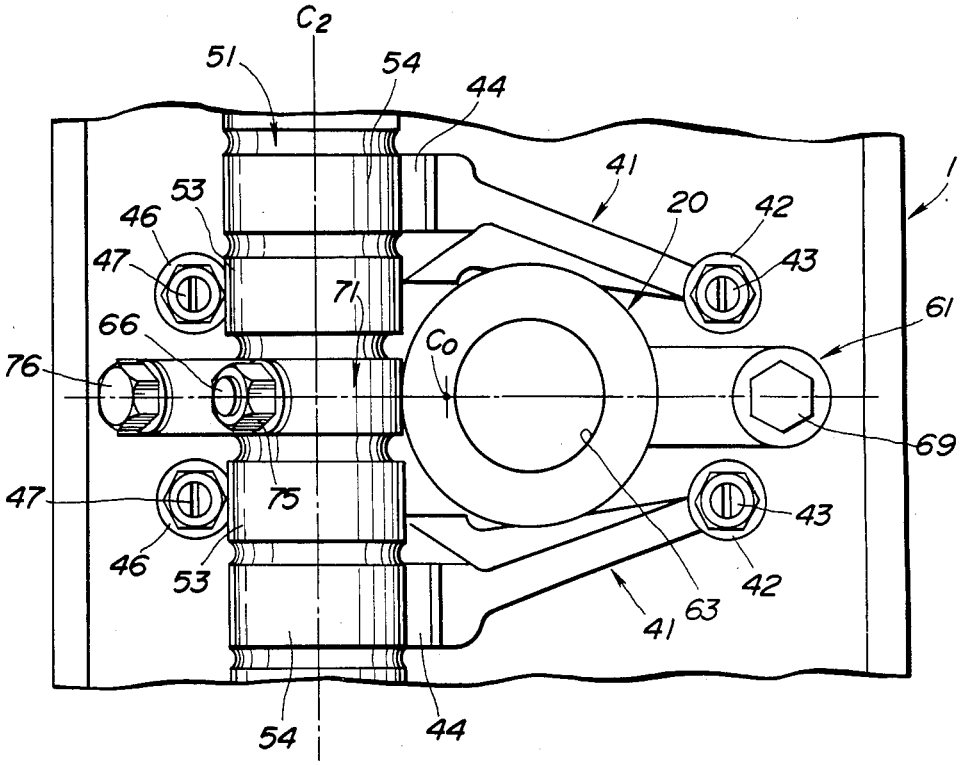
FIG. 2 is a fragmentary plan view of the valve operating mechanism shown in FIG. 1.
Figure 3:
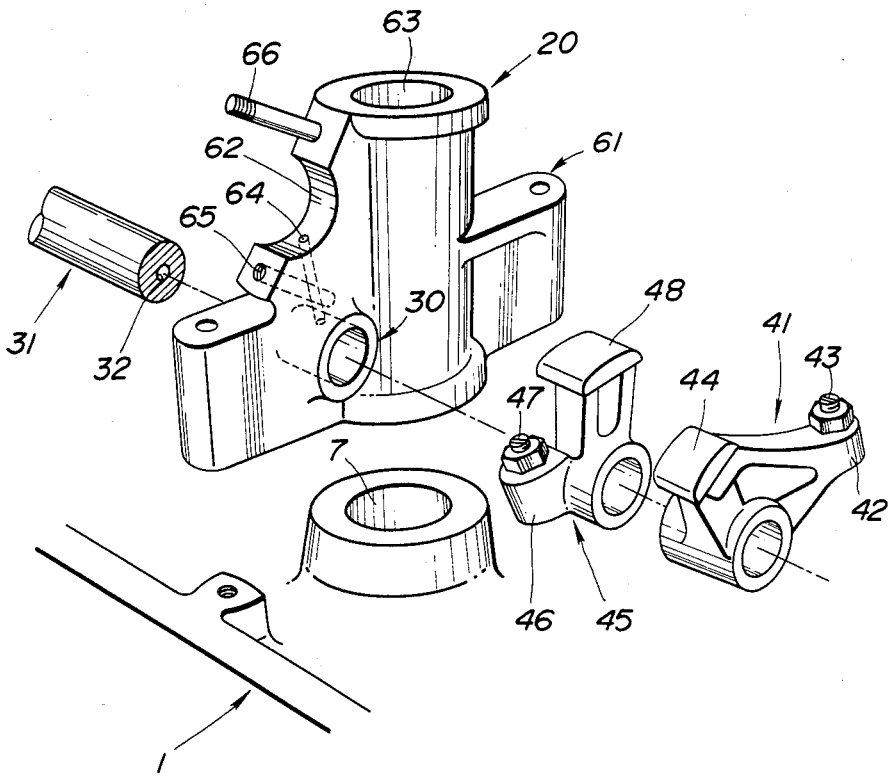
FIG. 3 is a perspective view of the valve operating mechanism shown in FIG. 1.

The camshaft 51 is disposed above the rocker arm shaft 31 and has its axis C2 displaced or offset from the rocker arm shaft axis C1 toward the side of the exhaust valve 15. The camshaft 51 has exhaust-valve cams 53 disposed one on each side of a journal 52 thereof and intake-valve cams 54 outside of the exhaust-valve cams 53, as shown in FIG. 2. The rocker arms 41, 45 have slippers 44, 48 held against the intake-valve and exhaust-valve cams 53, 54.

The cylinder head 1 has a plug insertion hole 7 defined therein above the combustion chamber 2 and substantially vertically aligned with the cylinder bore axis C0. A holder block 61 is mounted on the cylinder head and has a semicircular lower holder 62 for holding the camshaft 51, a circular rocker holder 30 through which the rocker arm shaft 31 extends, and a plug, insertion hole 63 defined vertically therethrough in alignment with the plug insertion hole 7.

The holder block 61 has an oil passage 64 (FIGS. and 4) providing communication between the inner surface of the lower holder 62 and the inner surface of the rocker holder 30, and a threaded hole 65 extending across the oil passage 64 below the lower holder 62. A stud bolt 66 is fixed to the holder block 61 above the lower holder 62.

An upper holder 71 for supporting the camshaft 51 has circular holes 72, 73 positioned above and below a semicircular bearing surface thereof. The upper holder 71 has an oil passage 74 connected to the lower circular hole 73 and extending in a direction normal to the sheet of FIG. 4.

For assembly, the holder block 61 is fixedly mounted on the cylinder head 1 by means of bolts 69, and then the rocker arm shaft 31 is inserted through the rocker holder 30 of the holder block 61. The rocker arm shaft 31 is locked at its opposite ends against rotation. One half of the journal 52 of the camshaft 51 is placed on the lower holder 62 of the holder block 61, and the upper holder 71 is fitted over the other half of the journal 52 while inserting the stud bolt 66 through the upper circular hole 72 of the upper holder 71. A nut 75 is fastened on the upper projecting end of the stud bolt 66, and a bolt 76 is inserted through the lower circular hole 73 threadedly into the threaded hole 65.

The separate lower and upper holders 62, 71, when thus assembled, jointly constitute a cam holder 50. The plug insertion hole 7 of the cylinder head 1 and the plug insertion hole 63 of the holder block 61 jointly form a plug insertion tube 20.

The two intake rocker arms 41 are bent toward the upper portion of the plug insertion tube 20 as shown in FIG. 2.

The head cover 81 is fixed to the cylinder head 1 in covering relation to the valve operating mechanism of the above construction, with a plug insertion hole 82 of the head cover 81 being joined to the plug insertion tube 20.

Figure 4:
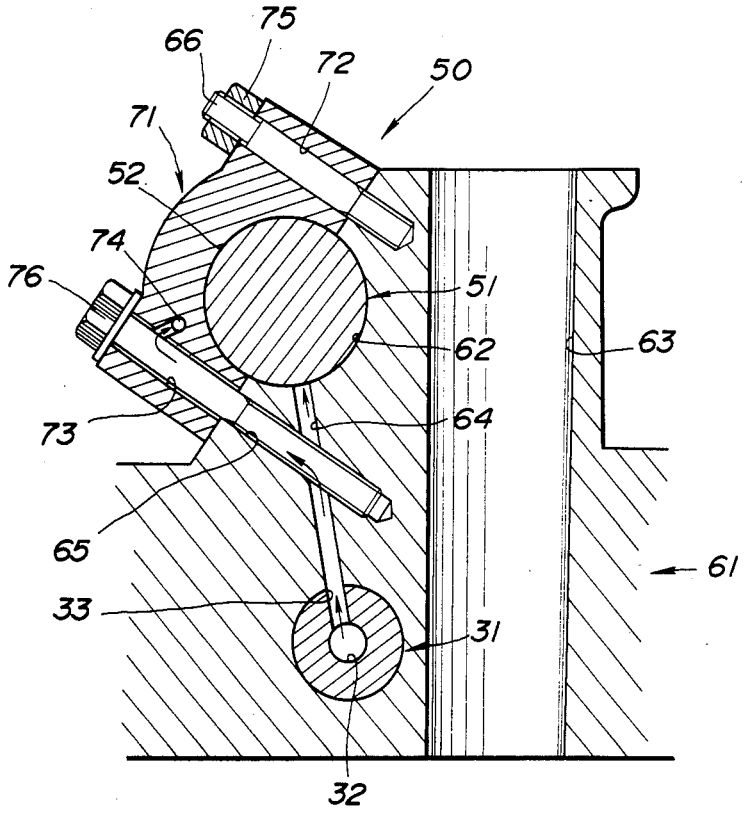
FIG. 4 is a vertical cross-sectional view showing a lubricating system.

As illustrated in FIG. 4, lubricating oil supplied under pressure to an oil passage 32 defined axially in the rocker arm shaft 31 flows from a radial oil passage 33 of the rocker arm shaft 31 through the oil passage 64 of the holder block 61 to the journal 52. At the same time, the lubricating oil flows from the oil passage 64 through a gap between the outer periphery of the bolt 76 crossing the oil passage 64 and the inner peripheries of the threaded hole 65 and the circular hole 73 of the upper holder 71 into the oil passage 74, from which the lubricating oil is scattered onto the cams 53, 54.

With the first embodiment, the spark plug 21 is centrally located for increased combustion efficiency, and the lower holder 62, the rocker holder 30, and the plug insertion tube 20 are integrally formed with each other. Such an integral construction dispenses with a separate plug insertion pipe, and reduces the number of parts required and the number of assembling steps.

Figure 5:
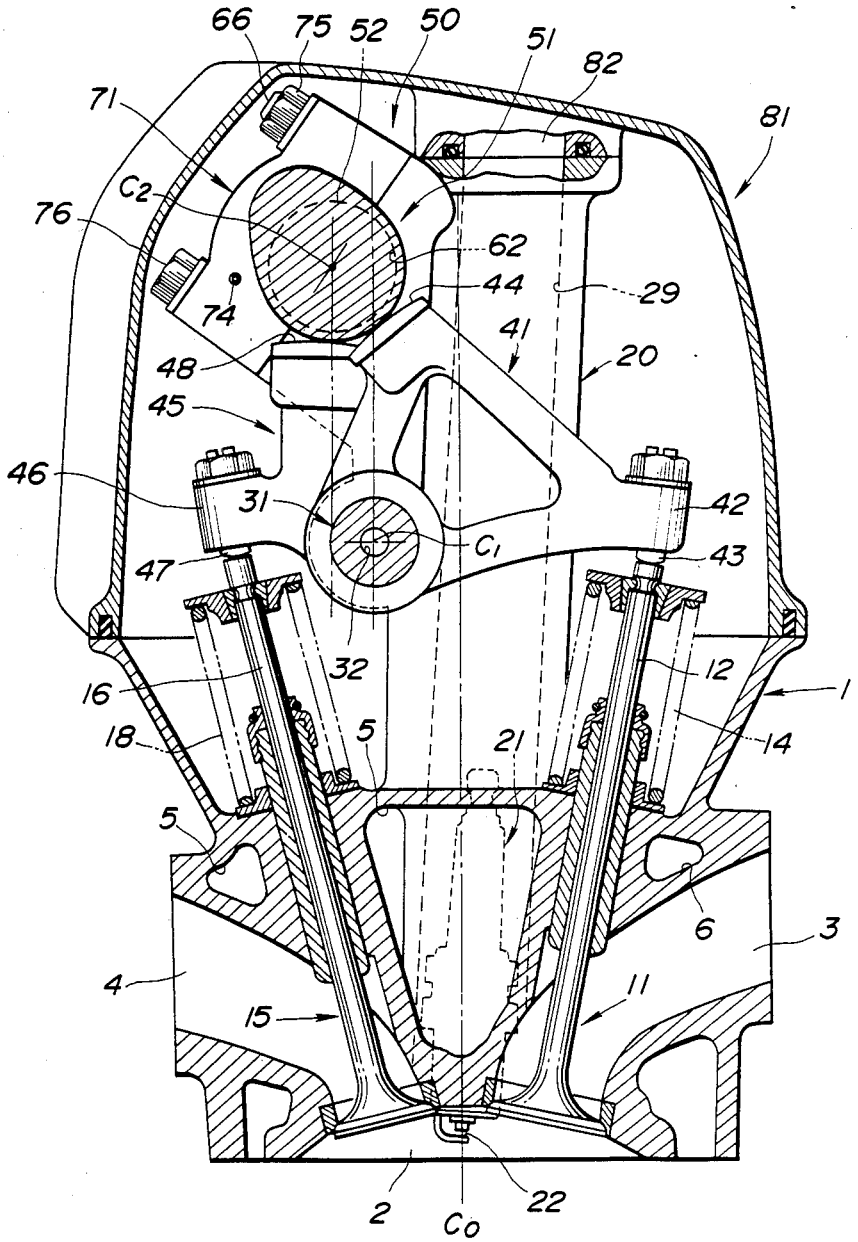
FIG. 5 is a vertical cross-sectional view of a valve operating mechanism according to a second embodiment of the present invention.
Figure 6:
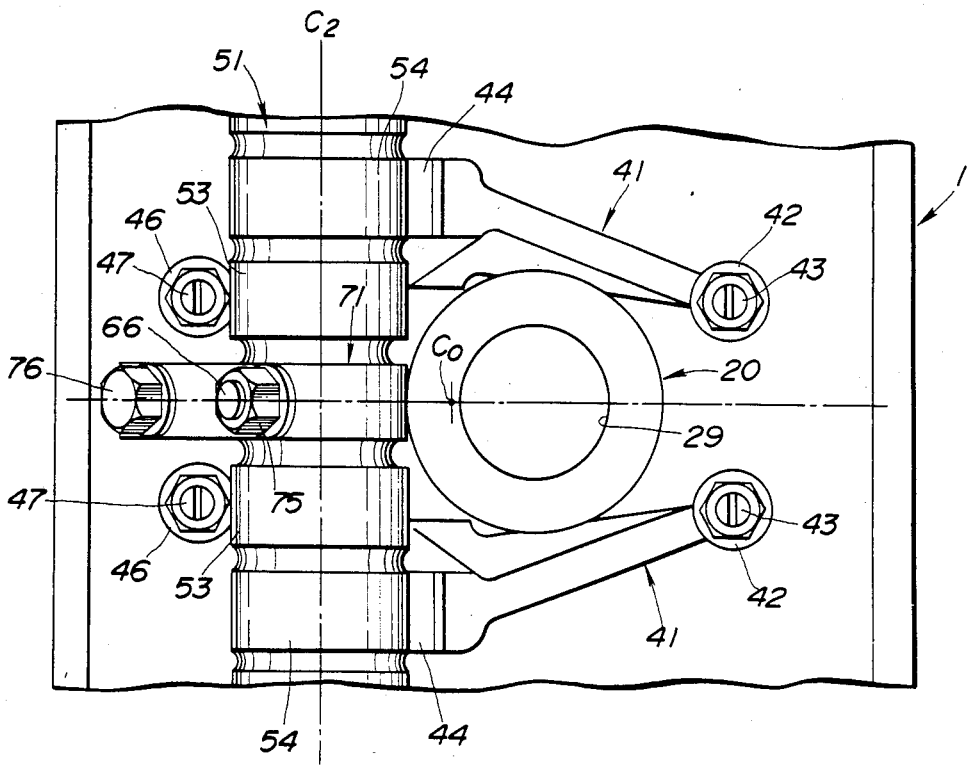
FIG. 6 is a fragmentary plan view of the valve operating mechanism shown in FIG. 5.
Figure 7:
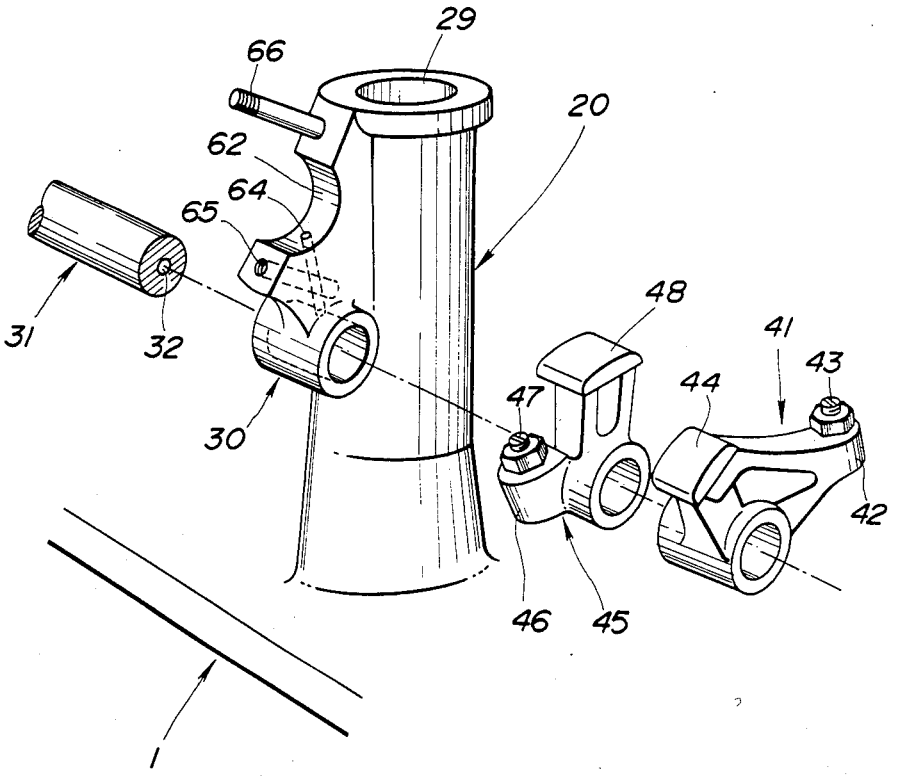
FIG. 7 is a perspective view of the valve operating mechanism shown in FIG. 5.

FIGS. 5 through 7 show a valve operating mechanism according to a second embodiment of the present invention. The valve operating mechanism of the second embodiment differs from the valve operating mechanism of the first embodiment in that a lower holder 62 of a cam holder 50, a rocker holder 30, and a plug insertion tube 20 are integrally formed with the cylinder head 1.

More specifically, the semicircular lower holder 62 and the circular rocker holder 30 are integrally formed with the cylinder head 1, and the plug insertion tube 20 with a plug insertion hole 29 defined therein is also integrally formed with the cylinder head 1. With the lower holder 62, the rocker holder 30, and the plug insertion tube 20 being thus integrally formed with the cylinder head 1, it is not necessary to seal the joint between the cylinder head 1 and the plug insertion tube 20. Therefore, the number of components used and the number of assembling steps required are greatly reduced. The valve operating mechanism of the second embodiment has the same lubricating system as that of the first embodiment.

Although there have been described what are at present considered to be the preferred embodiments of the present invention, it will be understood that the invention may be embodied in other specific forms without departing from the spirit or essential characteristics thereof. The present embodiments are therefore to be considered in all aspects as illustrative, and not restrictive. The scope of the invention is indicated by the appended claims rather than by the foregoing description.

We claim:

1. A valve operating mechanism in an internal combustion engine including a cylinder bore, a cylinder head disposed above the cylinder bore and having a combustion chamber, intake and exhaust valves movably supported in the cylinder head, and a spark plug supported in the cylinder head and having electrodes disposed centrally in the combustion chamber, said valve operating mechanism comprising:

a single camshaft rotatably disposed above said cylinder head;

a single rocker arm shaft rotatably disposed above said cylinder head;

an intake-valve rocker arm swingably supported on said rocker arm shaft and operatively engaging said intake valve;

an exhaust-valve rocker arm swingably supported on said rocker arm shaft and operatively engaging said exhaust valve;

a camshaft holder disposed above said cylinder bore, said camshaft being rotatably supported by said camshaft holder;

a rocker arm shaft holder disposed above said cylinder bore, said rocker arm shaft being rotatably supported by said rocker arm shaft holder; and a plug insertion tube having a plug insertion hole for insertion of the spark plug therethrough, said plug insertion tube being integrally formed with said camshaft holder and said rocker arm shaft holder in a holder block means.

2. A valve operating mechanism according to claim 1, wherein said plug insertion tube, said camshaft holder, and said rocker arm shaft holder are formed in said holder block means separate from and mountable on said cylinder head.

3. A valve operating mechanism according to claim 1, wherein said plug insertion tube, said camshaft holder, and said rocker arm shaft holder are integrally formed with said cylinder head.

4. A valve operating mechanism according to claim 1, wherein said camshaft axis and said rocker arm shaft axis are laterally offset from one another.

5. A valve operating mechanism according to claim 1, wherein said camshaft is disposed above the rocker arm shaft and has its axis offset laterally from the rocker arm shaft axis toward the side of the exhaust valve.

6. A valve operating mechanism according to claim 1, wherein at least one of said camshaft and rocker arm shaft are offset laterally from the axis of the cylinder bore for positioning said plug insertion tube very close to said axis.

* * * * *